US006446802B1

(12) United States Patent
Lutz et al.

(10) Patent No.: US 6,446,802 B1
(45) Date of Patent: Sep. 10, 2002

(54) KNIFE BLADE CONTAINER AND METHOD OF REMOVING BLADES FROM A CONTAINER

(75) Inventors: Alexander Lutz, Solingen-Gräfrath (DE); Frieder Lutz, Sprockhövel (DE)

(73) Assignee: Lutz Industria S.A., Delemont (CH)

( * ) Notice: Subject to any disclaimer, the term of this patent is extended or adjusted under 35 U.S.C. 154(b) by 0 days.

(21) Appl. No.: 09/579,923

(22) Filed: May 26, 2000

(30) Foreign Application Priority Data

Nov. 29, 1999 (EP) ..... 99123680

(51) Int. Cl.[7] ..... B25D 85/62
(52) U.S. Cl. ..... 206/354; 206/565; 211/51
(58) Field of Search ..... 206/352, 355–360, 206/461, 471, 559, 561, 565; 221/56–60, 101, 102, 226, 228, 232, 270, 279, 280; 211/51

(56) References Cited

U.S. PATENT DOCUMENTS 3,542,245 A * 11/1970 Braginetz ..... 221/232
3,650,433 A * 3/1972 Robertson ..... 221/232
3,767,083 A * 10/1973 Webb ..... 221/279
4,379,514 A * 4/1983 Joffe ..... 221/279
4,789,080 A * 12/1988 Iten ..... 221/279
4,826,042 A * 5/1989 Vujovich ..... 221/232
4,850,512 A * 7/1989 Vujovich ..... 206/355
5,251,783 A * 10/1993 Gringer ..... 221/279
6,158,616 A * 12/2000 Huang ..... 221/270

FOREIGN PATENT DOCUMENTS

| | | |
|---|---|---|
| DE | 94 17 521 | 1/1995 |
| DE | 295 11 834 | 9/1995 |
| FR | 2 474 452 | 7/1981 |

* cited by examiner

*Primary Examiner*—Jim Foster
(74) *Attorney, Agent, or Firm*—Pearne & Gordon LLP

(57) ABSTRACT

A container has an internal cavity for receiving knife blades lying side by side in a stack, the internal cavity being capable of being reduced in size by a slide member which is preferably displaceable in only one direction. In this way the blades are located in position however full the container is, and damage to the cutting edges by movement or slipping in the package is avoided. Furthermore a method is proposed by which first the blade which lies against the slide is extracted from the stack and then the slide member is urged against the stack of blades.

19 Claims, 4 Drawing Sheets

KNIFE BLADE CONTAINER AND METHOD OF REMOVING BLADES FROM A CONTAINER

The invention relates to a container for handling knife blades, in particular such as is used for the storage, transport and individual removal of blades.

Such containers are used in particular where the need arises to make blades available for cutting operations. Manual cutting or filleting processes are often performed using a knife, the knife comprising a re-usable handle and a throw-away blade taken from the container. The blades are conventionally arranged in stacks which lie flat and are secured in a box, generally made out of cardboard. As long as the package is completely filled the blades in it cannot move and cause their cutting edges to strike against one another. With increasing removal of blades individual blades can however move back and forth in the pack and in particular the vulnerable cutting edges of the blades can strike against other blades. As the cutting edge is finished to a fine degree in the micron region, it is a delicate, very sharp but statically extremely vulnerable micro system which, when it comes into contact with hard objects can be damaged or even destroyed by only slight forces. Any damage, which may not be visible to the naked eye, makes the blade a scrap component, since the cutting function of the blade is achieved by the cutting edge alone.

Since the cutting operations described above are mostly performed as piece work such damaged knife blades have an adverse effect on the piece work performance of the worker, who therefore often takes out a further new blade, resulting in increased costs for the manufacturing operation.

Furthermore, such knife blades may be used to provide cutting machines with one or more blades operating simultaneously. In blades thus stored in "loose order" this results in costs which are avoidable from several aspects. In the setting up of a cutting machine with for example 40 simultaneously operating knife blades, the operator finds it advisable to lay out the blades in a way which makes them easy to pick up. Picking up blades which lie spread around in a box, by contrast, takes up time and gives rise to a danger of injury. Another disadvantage is that when even only one blade in the set has a blunt cutting edge as a result of faulty storage, the whole set may be rejected. Overall an indeterminate and unpredictable risk of rejection results from the conventional way of storing knife blades.

In current practice, when the blades are put in the box it is filled up with filling materials in order to locate the blades, at least initially. Also when a conventional box for blades is only to be half-filled with blades (half pack size) the empty space left in the box is normally filled up in a material-intensive way using foam or cardboard filling.

Accordingly it is an aim of the present invention to provide an improved container for knife blades as well as to improve the removal of the blades.

According to the present invention, a container for knife blades has an internal cavity, said internal cavity holding knife blades arranged side by side in a stack, and a slide member located in said container and in engagement with said stack of knife blades, said slide member being adapted to move to reduce the size of said internal cavity.

Thus the container according to the invention has an internal cavity for holding the stack of knife blades, and which can be reduced in size according to the size of the stack by means of the slide member, whereby the result is achieved that the blades mounted in the container do not move around and cannot strike against one another. In particular this achieves the result that after the manufacture of the blade the finely finished cutting edge can only come into contact with the packaging, generally of cardboard or plastics, so that the cutting edge is not damaged.

In one embodiment the slide member can slide in only one direction, e.g. by means of a guide based on the ratchet principle, the slide being capable of being urged in a direction towards the stack of blades with minimal force, but not being able to slide back. Accordingly the location is still maintained even in the event of a shock or impact against the container, e.g. on it falling over or being dropped.

If the slide member and the rail are provided with mutually inter-engaging detents, a stepwise adjustment of the position of the slide is made possible, an increased force needing to be applied to overcome a detent position.

According to one particularly preferred embodiment the interengaging detents are of sawtooth form. When it is desired to move the slide towards the stack of blades the inclined flanks of the teeth of the inter-engaging detents slide over one another, whilst on any unwanted reverse movement the then adjacent perpendicular flanks of the teeth come into engagement and prevent or at least make difficult any reverse movement.

A base of the container may have a recess for receiving a rail designed to guide the slide member. The arrangement is such that an upper face of the rail lies in the same plane as the base so that the knife blades lie against a substantially continuous surface without rattling.

If, according to a preferred embodiment, the rail has two lower flanges on the side adjacent to the base by which the rail is wider than the slide in the region of the engagement, there is always play between the slide member and side walls which bound the recess in base. Accordingly the slide member does not rub against the base.

The slide member may have interengaging portions engaging over the upper flange of the rail to provide a mechanical inter-engagement. This provides stability of the slide member against tilting and rotation, together with good sliding and guiding characteristics.

The slide member may have a guiding membe and/or a wall member bounding the internal cavity. The guiding member is provided for moving the slide member. The guiding member is constructed so that the slide is particularly easy to move in the desired direction, which can for example be achieved by arranging that the guiding member is upwardly inclined in the direction of sliding or it has a surface which is able to be grasped preferentially in the direction of sliding, which can also be achieved by providing openings in the guiding member.

Openings provided in the guiding member are particularly advantageous if for example the rail which is made overall of a yellow colour is visible through a dark-coloured guiding member and the openings have shapes (e.g. an "arrow" motif), which are of assistance in explaining the manner of using the article and accordingly serve as an operating instruction. In this way there is no need to print or stick on labels for such indications.

In one embodiment a gap is provided in the wall member provided on the slide member, making it possible to engage the currently leading blade in the stack with the finger and to withdraw it from the stack using the frictional force arising between blade and finger.

The rail is particularly adaptable in use if for example preferential fracture points are provided, formed by thinning of the material, by which the rail can easily be shortened by breaking off to different lengths for different packs. In this way the number of variants which need to be manufactured is reduced and the rail is cheap to manufacture by virtue of the large numbers produced.

The container for the blades can be made either conventionally of cardboard or can be formed of an upper and lower shell of deep-drawn polystyrene or other plastics.

A further embodiment of the invention envisages that an insert of deep-drawn polystyrene or another plastics is provided in the lower shell of the container and matched to the rail and blades to be received on it.

The invention also relates to a method of removing knife blades from a stack in a container, wherein at least one blade is removed from the stack, and slide means arranged in the container are displaced towards the stack of blades.

The aspects of the invention are illustrated by way of example in the accompanying drawings, in which.

Figure 1:
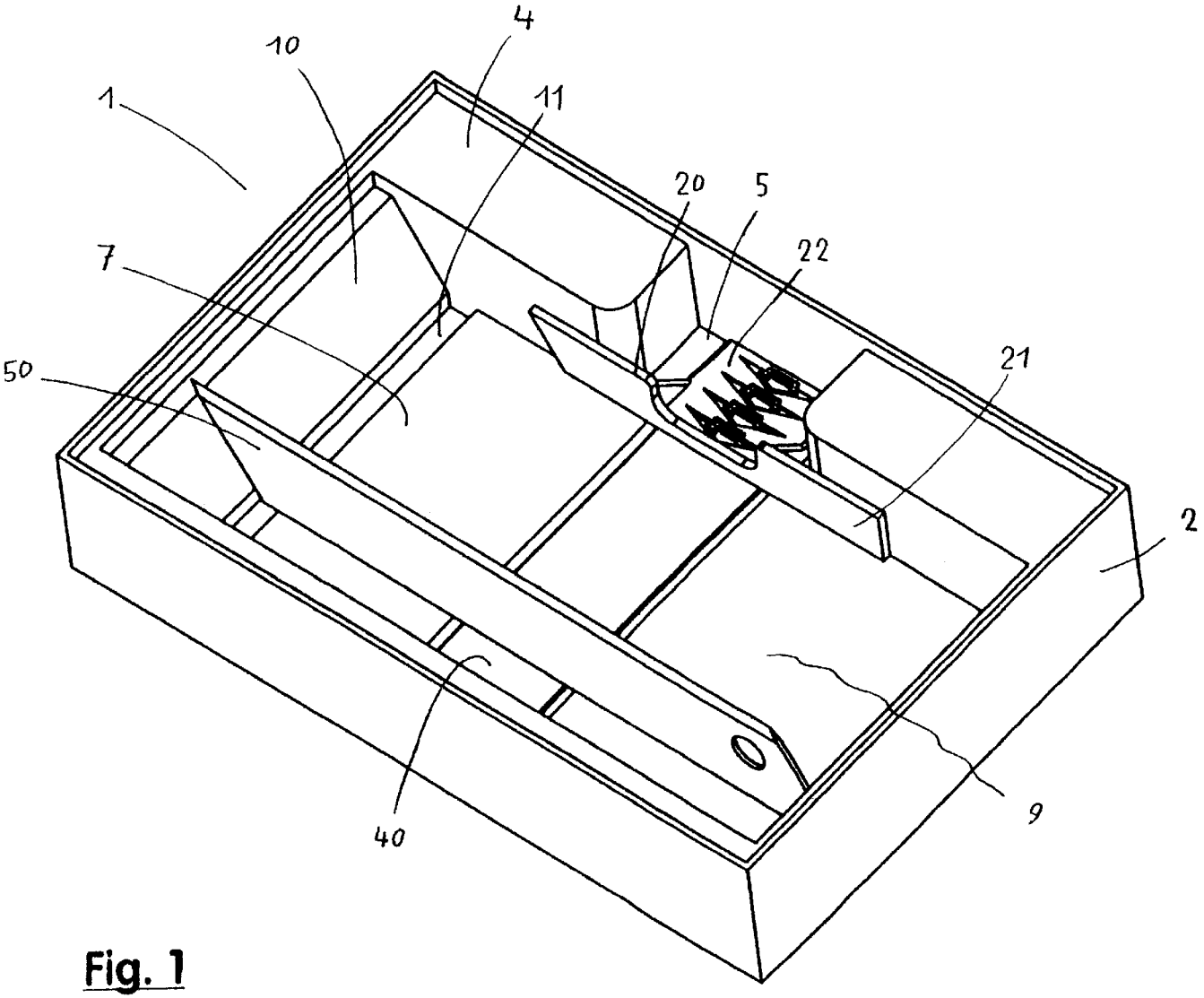
FIG. 1 is a perspective view of a container according to the invention with slide member and a blade.

FIG. 1 shows a container 1 for knife blades. The container has a lower shell 2 which receives a specially shaped insert 4. The insert 4 is shaped to define an internal cavity 9 having side walls 10. The cavity 9 receives in a bed-like manner a stack of knife blades 50, only one of which is shown in the drawing. The insert 4 has a recess in the base 7 for receiving a rail 40, so that the base 7 of the insert 4 and the upper surface of the rail 40 lie in a common plane. A slide member 20 guided by the rail 40 and adapted to act on the blades 50 is situated in the position shown in FIG. 1, with a guiding member 22 in a recess 5 left free in the insert 4.

The use of the container will now be explained initially without going into further detail on the shape of the individual components. The slide member 20 is movable along the rail 40. By displacement of the slide member towards the opposite wall of the container it would consequently be possible to hold securely even the single knife blade 50, shown in the drawing.

The position of the slide member 20 illustrated in FIG. 1 would in fact be adopted if the container were completely full with a stack of knife blades 50. Any relative movement of the blades and consequent damage to the highly vulnerable cutting edges is eliminated, as the blades are located laterally by a wall part 23 of the slide member 20, and in the longitudinal direction the side walls 10 of the insert 4 act on the blades. The connection between the slide member 20 and rail the 40 is such that the slide member can be pushed only in a direction towards the stack of blades and pressed against the blades. Hook-shaped detents in the guide for the slide prevent any reverse movement of the slide. The recess 5 provided in the insert 4 serves on the one hand for receiving the guiding member 22 of the slide when the container is completely filled with blades and on the other hand it allows the user, with a finger, to engage the side face of the leading blade 50 lying against the slide member 20 and to extract it.

Figure 2:
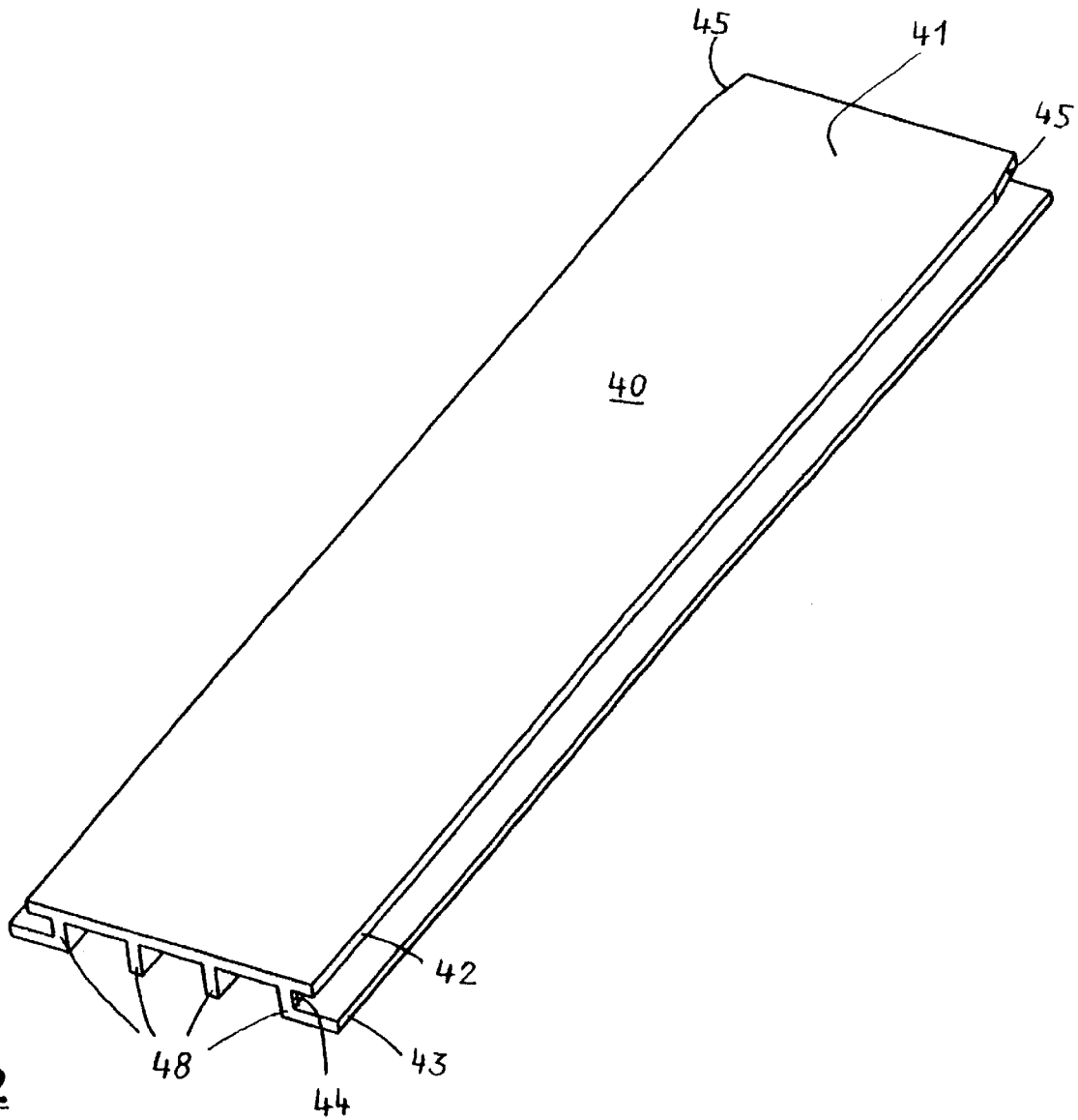
FIG. 2 is a perspective view of a rail for guiding the slide member.
Figure 6:
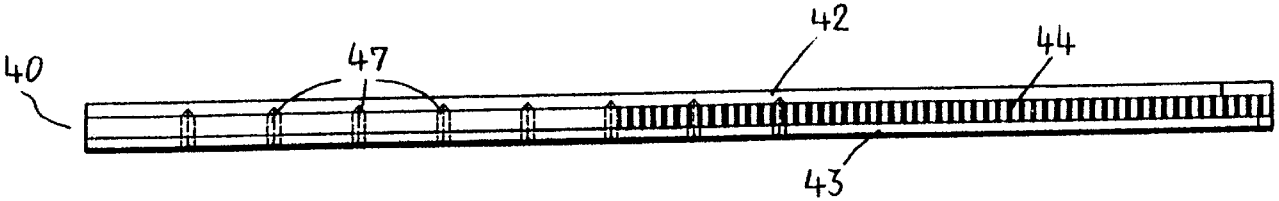
FIG. 6 is a side view of the rail of FIG. 2.

FIG. 2 shows in conjunction with FIG. 6 the construction of the rail 40. An upper face 41 of the rail, which is flat, is reinforced on its underside by parallel ribs 48 running in a longitudinal direction, the upper face 41 of the rail projecting above both outer longitudinal ribs 48 in the form of upper flanges 42 extending in a longitudinal direction. There is furthermore at the bottom edge of both the outer longitudinal ribs 48 a respective lower flange 43 extending away from the rail and running parallel to the upper flange 42 but projecting beyond it. The maximum width of the rail 40 is therefore determined by the lower flanges 43. Sawtooth-like detents 44 are formed on the outer face of the outer longitudinal ribs 48 and they co-operate with the detents 25 on the slide member to allow sliding of the slide member 20 on the rail 40 in only one direction.

It can be seen in FIG. 6 that preferential fracture points are provided perpendicular to the direction of the length of the rail by thinning down of the material. These preferential fracture points make it possible to shorten the rail deliberately to match the length of the package which is to receive the rail/slide system and it is accordingly very economical to manufacture as it is not necessary to produce different versions and no labour-intensive adjustment of the length by sawing is needed. The detents 44 extend along the entire length of the rail and are only illustrated partially in FIG. 6 in the interests of greater clarity.

Figure 3:
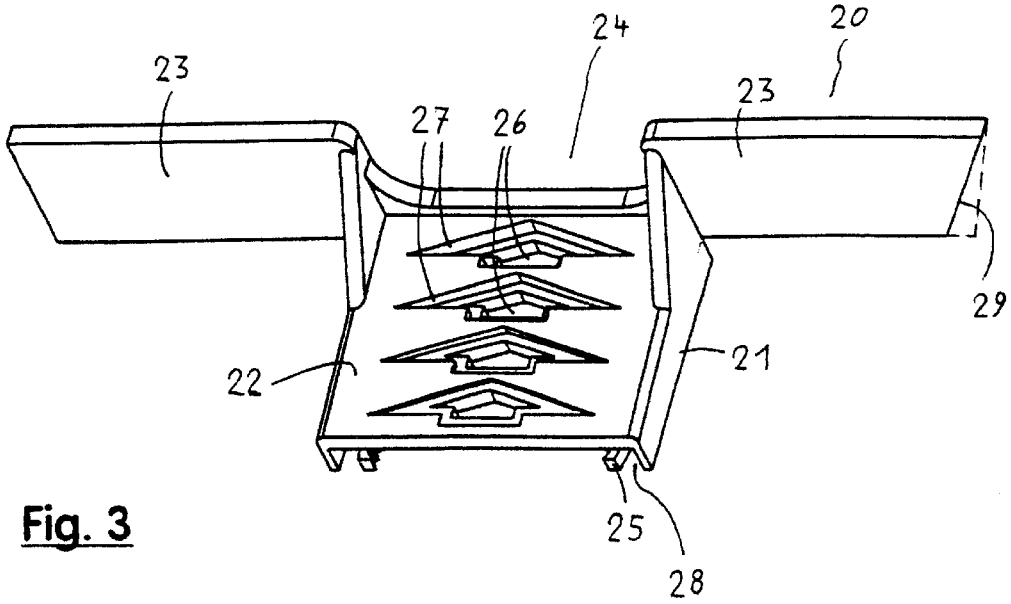
FIG. 3 is a perspective view of the slide member of FIG. 1.
Figure 4:
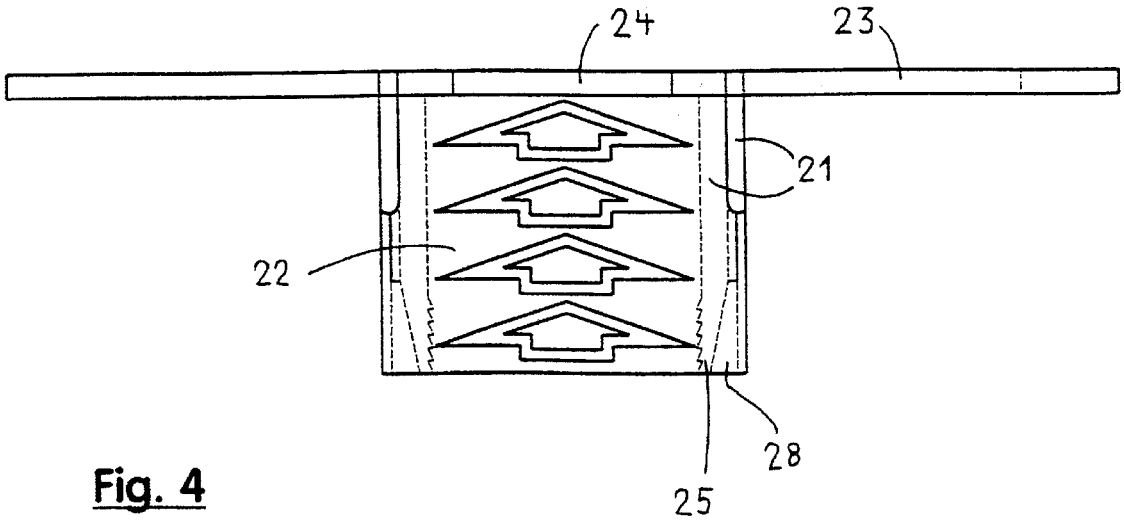
FIG. 4 is a top view of the slide member of FIG. 3.

FIGS. 3 and 4 show the features of the slide member 20, which comprises substantially the guiding member 22 with engaging means 21 provided for guiding on the rail 40 and the wall member 23 for engagement with the knife blades 50. On assembly with the wall member 23 the slide member 20 is first fitted onto the reduced end 41 of the rail 40 such that the engaging means 21 embrace the upper flanges 42 of the rail 40 on both sides. As shown the rear portion of the engaging means 21 is made in the form of detents 25 which are arranged on a resilient portion of the engaging means 21, explained in more detail below.

The detents 25, which are of sawtooth shape, are similar to the detents 44 on the rail 40. If both detents 25, 44 are made of sawtooth shape the result is that the slide member can be displaced on the rail only in one direction. This achieves the result that the slide can only be used to press against the blades 50 and can be held in this position. The resilient mounting of the detents 25 on the slide is achieved in that the rear (looking in the direction of sliding) part of the engaging means 21 stands free in the region of the detents 25. In this way this component, with appropriate design and material such as for example, polyamide (PA) or acetal resin (POM) is able to give as it slides over the rail detents 44.

The guiding member 22, which rests on the rail 40 and engages over it, serves at the same time as a form of handle, i.e. the user, after removing one or more knife blades with the thumb or finger, will press on the upper surface of the guiding member 22 and thereby move the slide member towards the blades until they are engaged and squeezed together by the slide member 20. In order to simplify handling, the following features are provide. The upper surface of the guiding member 22 lies at an angle of e.g. 5°–45° to the upper surface 41 of the rail and accordingly it is inclined slightly upwards in the direction of displacement, easing the application of a force by the user's finger. Furthermore there is provided a profile 27—shown in the form of an arrow in the embodiment by way of the example—which also forms an indication for the manner of use. The profile is made in the form of openings 26. The arrow-shaped openings reveal the rail 40 which lies underneath the guiding member, so that the arrow shape stands out particularly well if slide and rail are made of differently coloured materials. All the features pointed out on the guiding member 22 serve to allow intuitive operation and to assist the desired displacement of the slide member towards the blades and make incorrect operation difficult. In particular in the embodiment shown there is no need for any printed information on the slide.

The wall member 23 arranged at an angle to the guiding member 22 serves to support the blades 50 from the side. A gap 24 is provided in the middle of the wall member 23 allowing access for engaging and withdrawing the blade 50 which is currently against the slide.

Especially in the case of very small (about 10–50 mm) and/or flexible blades a particularly secure location is achieved if the wall member 23 is made of a shape according to the blades which it supports. For this purpose also—differing from what is shown in FIG. 1 for large blades—a chamfer 29 at the end of the wall member 23 in an outward direction can extend out as far as the side wall 10 of the insert 4.

The embodiment by way of example described above is primarily envisaged for making from plastics, preferably of polystyrene with a recess for receiving the rail 40 in the floor. The rail and the slide and the insert can be made as injection mouldings.

Figure 5:
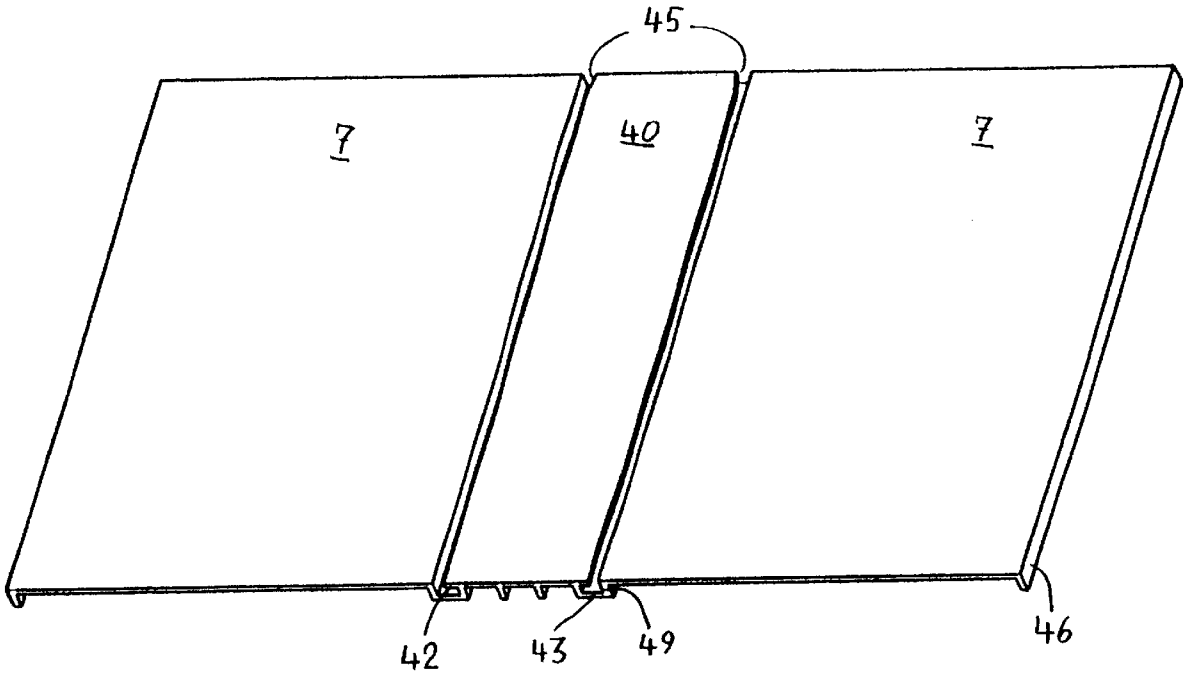
FIG. 5 is a perspective view of a further rail for containers with no base recess.

Another embodiment of the rail 40 is shown in FIG. 5. All the previously described features of the rail 40 are present with the exception that at both sides on the outer ends of the lower flange 43 there are formed base plates 7 joined to the rail by a connecting web 49. The base plates 7 are each terminated at their outer edges by supporting flanges 46 which extend the same distance below the base plates 7 as the lower flanges 43. The embodiment according to FIG. 5 makes it possible to use the invention in a container which does not have a specially shaped interior, such as for example a normal cardboard box without a recess for the rail. The advantage lies in the fact that conventional environmentally friendly articles of cardboard which have up to now been preferred for use for packing blades can still be used and then only need to be subsequently fitted with the rail/base plate according to FIG. 5 and the slide according to FIG. 3.

What is claimed is:

1. A container for knife blades having an internal cavity, said internal cavity holding knife blades arranged side-by-side in a stack, rail means for guiding a slide member mounted within said container, said rail means being non-integral with said container, and said slide member being guided by said rail means within said container for engagement with said stack of knife blades, said slide member being adapted to move in only one direction along said rail means to reduce the size of said internal cavity.

2. A container according to claim 1, wherein said container is formed of a first material and said rail means is formed of a second material, said first and second materials being of different compositions and having different physical properties.

3. A container according to claim 1, wherein detents are provided on said slide member and on said rail means, and said detents interact so that said slide member can be displaced in only one direction.

4. A container according to claim 3, wherein said detents are of sawtooth shape.

5. A container according to claim 1, wherein said container has a base, said base having a recess for receiving said rail means.

6. A container according to claim 5, wherein said rail means includes an upper surface, said base includes an upper surface, and said rail means is received in said recess so that said upper surfaces of said rail means and said base lie in the same plane.

7. A container according to claim 1, wherein said rail means has on each side thereof a flange extending in a transverse direction.

8. A container according to claim 1, wherein said rail means has on each side thereof an upper flange extending in a transverse direction, said upper flanges tapering adjacent an end of said rail means.

9. A container according to claim 5, wherein said rail means has an upper side remote from said base, a lower side adjacent said base, a pair of upper flanges extending in a transverse direction with respect to said rail means and a pair of lower flanges extending in a transverse direction with respect to said rail means, said slide member including an engaging portion for mounting said slide member to said upper flanges of said rail means, and said lower flanges are wider than said engaging portion of said slide member.

10. A container according to claim 7, wherein said slide member has two mechanically inter-engaging portions and said rail means has upper flanges extending on each side in a direction transverse to said rail, said portions of said slide member engaging with respective upper flanges of said rail means.

11. A container according to claim 1, wherein said slide member has a guiding member or a wall member bounding said internal cavity.

12. A container according to claim 11, wherein said guiding member is made upwardly inclined in the direction of displacement.

13. A container according to claim 11, wherein said guiding member has a surface which is engagable to move in the direction of the displacement.

14. A container according to claim 11, wherein openings in the shape of operating symbols are provided in said guiding member, said rail means being visible through said openings.

15. A container according to claim 11, wherein said wall member of said slide member has a gap for access.

16. A container according to claim 5, wherein said rail means has a longitudinal axis extending in the direction of movement of said slide member and preferential fracture points extending perpendicular to the longitudinal axis for shortening the length of said rail means by breaking it off at said preferential fracture points.

17. A container according to claim 1, wherein said container comprises an upper shell and a lower shell, of deep-drawn polystyrene or cardboard, said lower shell housing said internal cavity.

18. A container according to claim 5, wherein said internal cavity is formed by an insert in which is formed said recess for said rail, an opening for engaging said slide member and for grasping the blades or receiving the blades.

19. A container according to claim 1, wherein said container has a base for supporting said rail means and an open top, opposed from said base, through which said knife blades are withdrawn from said stack, said rail means comprising a rail supported on said base and having a flat surface remote of said base for engaging edges of said knife blades and supporting said stack of knife blades, whereby knife blades may be withdrawn from said stack through said open top of said container by movement of the knife blades in a direction perpendicular to said stack and flat surface of said rail.

* * * * *